US005507120A

United States Patent [19]

Current

[11] Patent Number: 5,507,120

[45] Date of Patent: Apr. 16, 1996

[54] TRACK DRIVEN POWER DOOR OPERATOR

[75] Inventor: Andrew Current, Oglesby, Ill.

[73] Assignee: Schlage Lock Company, San Francisco, Calif.

[21] Appl. No.: 453,431

[22] Filed: May 30, 1995

[51] Int. Cl.[6] ..... E05F 15/10

[52] U.S. Cl. ..... 49/340; 49/139; 74/89.15

[58] Field of Search ..... 49/340, 341, 139; 74/127, 89.15

[56] References Cited

U.S. PATENT DOCUMENTS

| | | | |
|---|---|---|---|
| 1,335,429 | 3/1920 | Danielson . | |
| 2,366,613 | 1/1945 | Hagstrom | 268/120 |
| 2,504,408 | 4/1950 | Griffin | 268/65 |
| 3,394,499 | 7/1968 | Korthaus et al. | 49/340 |
| 3,774,462 | 11/1973 | Thompson | 74/89.15 |
| 3,874,117 | 4/1975 | Boeam | 49/340 X |
| 3,964,125 | 6/1976 | Tansley | 16/48.5 |
| 4,040,144 | 8/1977 | Lasier et al. | 16/66 |
| 4,286,411 | 9/1981 | Wikkerink | 49/252 |
| 4,497,135 | 2/1985 | Vetter | 49/280 |
| 4,506,407 | 3/1985 | Downey | 16/48.5 |
| 4,551,946 | 11/1985 | Yoshida et al. | 49/340 |
| 4,565,104 | 1/1986 | Akin | 74/89.15 |
| 4,653,229 | 3/1987 | Feucht et al. | 49/367 |
| 4,979,261 | 2/1990 | Lasier et al. | 16/62 |
| 5,018,304 | 5/1991 | Longoria | 49/340 |
| 5,040,331 | 8/1991 | Merendino et al. | 49/340 X |
| 5,309,676 | 5/1994 | Applemann et al. | 49/253 |
| 5,375,374 | 12/1994 | Rohroff, Sr. | 49/340 |
| 5,386,885 | 2/1995 | Bunzl et al. | 49/340 X |

*Primary Examiner*—Philip C. Kannan
*Attorney, Agent, or Firm*—Keith F. Noe; Robert F. Palermo

[57] ABSTRACT

A track driven power door operator selectively and automatically opens a door swingably mounted on a door frame. The power door operator includes an elongate track housing mounted on the door frame and a power screw disposed within the track housing. A drive is provided for powering the rotation of the power screw about the horizontal axis for moving a slider block linearly along the horizontal axis upon its activation. An arm link is pivotally connected at one of its ends to the slider block and pivotally connected at its other end to the door. A control is provided for controlling the operation of the motor for moving the slider block which rotates the door between its closed and open positions.

8 Claims, 4 Drawing Sheets

TRACK DRIVEN POWER DOOR OPERATOR

BACKGROUND OF THE INVENTION

This invention generally relates to automatic door openers, and more particularly to a track driven power door operator for selectively and automatically opening a door swingably mounted on a door jamb.

In 1991, rules promulgated pursuant to the Americans with Disabilities Act (ADA) require that certain public buildings must remove barriers and provide people with disabilities access equal to, or similar to, that available to the general public. One area covered by these rules is the provision of accessible door openings. The ADA requires, among other things, door openings at least thirty-two inches wide, easily manipulated door handles, a maximum opening force for opening doors, a minimum closing time, and doors capable of opening at least ninety degrees. Automatic door openers have been developed in order to meet the standards set by the ADA and to enable people with disabilities to easily access buildings.

The present invention is in the same general field as the door assister disclosed in U.S. Pat. No. 4,040,144 to Lasier et al. and represents improvements thereover. The door assister disclosed in this patent includes a rack and pinion arrangement for lessening the force required to open a door. More particularly, the door assister includes a pneumatic and hydraulic arrangement which powers the rack when a person applies a small opening force on the door for reducing the opening force required to open the door. One problem associated with this type of door opener is that due to its relatively complex nature (i.e., in that it requires pneumatic and hydraulic components), it is somewhat expensive to assemble and install. Also, it is incompatible with existing door closer assemblies which provide a closing force on the door after it has been opened.

The foregoing illustrates limitations known to exist in present door opening and closing assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a track driven power door operator for selectively and automatically opening a door swingably mounted on a door jamb. The power door operator comprises an elongate track housing mounted on the door jamb along a generally horizontal axis. A power screw is disposed within the track housing and extends along the horizontal axis. A drive is provided for powering the rotation of the power screw about the horizontal axis for moving a slider block having a threaded bore threadably engaging the power screw linearly along the horizontal axis upon activation of the drive and the rotational movement of the power screw. An arm is pivotally connected at one of its ends to the slider block and pivotally connected at its other end to the door. A control device is provided for controlling the operation of the motor which moves the door between a closed position and an open position. The control device activates the drive for moving the slider block from a first position in which the door is closed to a second position in which the door is fully open, and any position in between.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
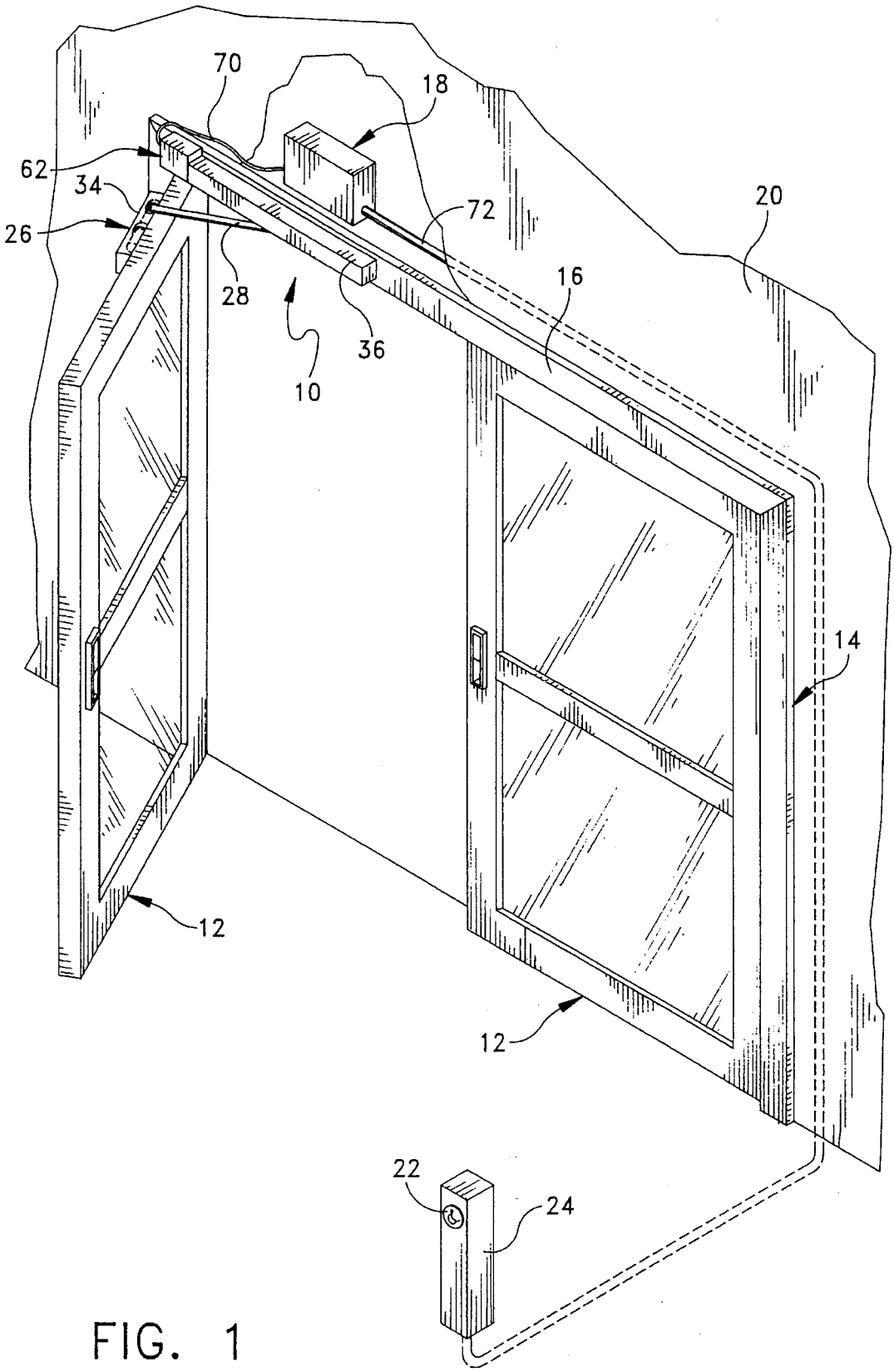
FIG. 1 is a perspective, environmental view with portions removed of a pair of doors swingably mounted on a door jamb which are selectively and automatically opened by a track driven power door operator of the present invention.

Referring now to the drawings, wherein similar reference characters designate corresponding parts throughout the several views, the embodiment of the apparatus shown in FIG. 1 comprises a track driven power door operator 10 according to one embodiment of the invention. More specifically, the door operator 10 is provided for selectively and automatically opening one of two doors, each generally indicated at 12, swingably mounted on a door jamb, generally indicated at 14.

FIG. 1 illustrates the door operator 10 of the present invention mounted on the top door frame member 16 for opening the left-hand door 12. Although only one door operator 10 is shown for opening one of the two doors 12, it should be understood that two door operators could be provided for opening both of the doors 12. It should also be noted that the door operator 10 instead of being mounted on the exterior of the top door frame member 16 can be mounted within the door frame member 16 if it is desired to conceal it. Concealed door operators are well-known in the art of automatic door openers.

The door operator 10 is in electrical communication with a control device, generally indicated at 18, which is housed interiorly within a wall 20 to which the door frame 14 is attached. The control device 18 may alternatively be provided within the ceiling or in a mechanical room, for example. The control device 18 includes a suitable microprocessor for controlling the door operator 10 to open the door 12. In the shown embodiment, the control device 18 is in electrical communication with a switch plate 22 mounted on a post 24 in front of the door 12. The arrangement is such that a handicapped person, for example, desiring to enter through the door 12 need only press the switch plate 22 for activating the door operator 10 which opens the door 12. Another embodiment (not shown) can be to place a sensor in front of the door 12 and have it automatically open upon being triggered by a person standing in front of the door. However, one advantage to the shown embodiment is that a person may open the door 12 manually or press the switch plate 22 on the post 24 for automatically opening it.

The door operator 10 of the present invention is designed for working in concert with a manual door closer assembly, generally indicated at 26, which is connected to the door operator 10 by a closer arm link 28. The arrangement is such that after the door operator 10 opens the door 12 via the arm link 28, the door closer assembly 26 provides a closing force on the arm link 28 to close the door 12. The door closer assembly 26 is of standard construction and capable of providing a closing force on the door 12 when it is in an open position and may also be adapted for stopping the opening movement of the door 12 upon its reaching a predetermined angle of rotation.

Figure 2:
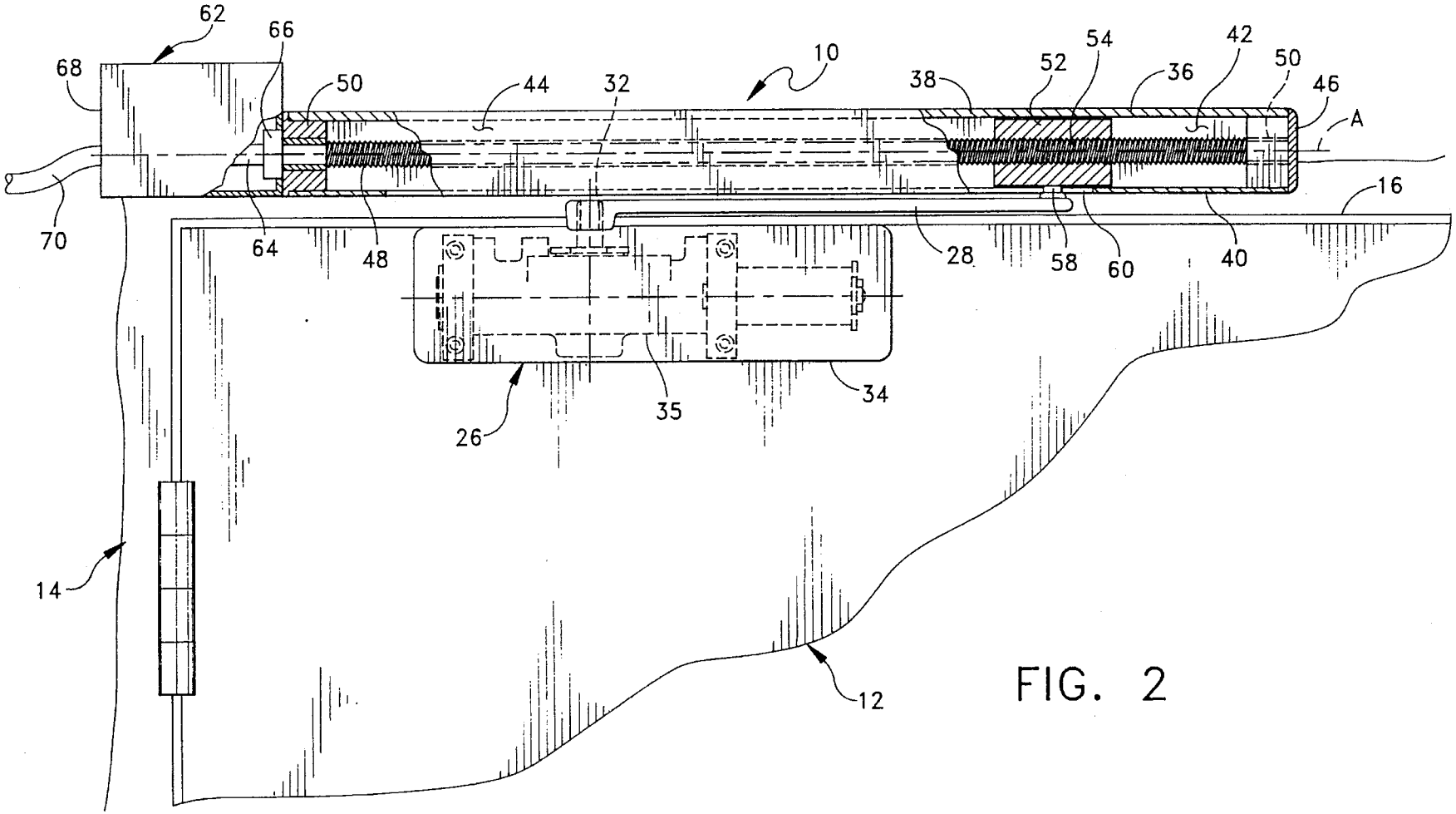
FIG. 2 is an enlarged, partial cross section elevational view of the door operator illustrated in FIG. 1.
Figure 3:
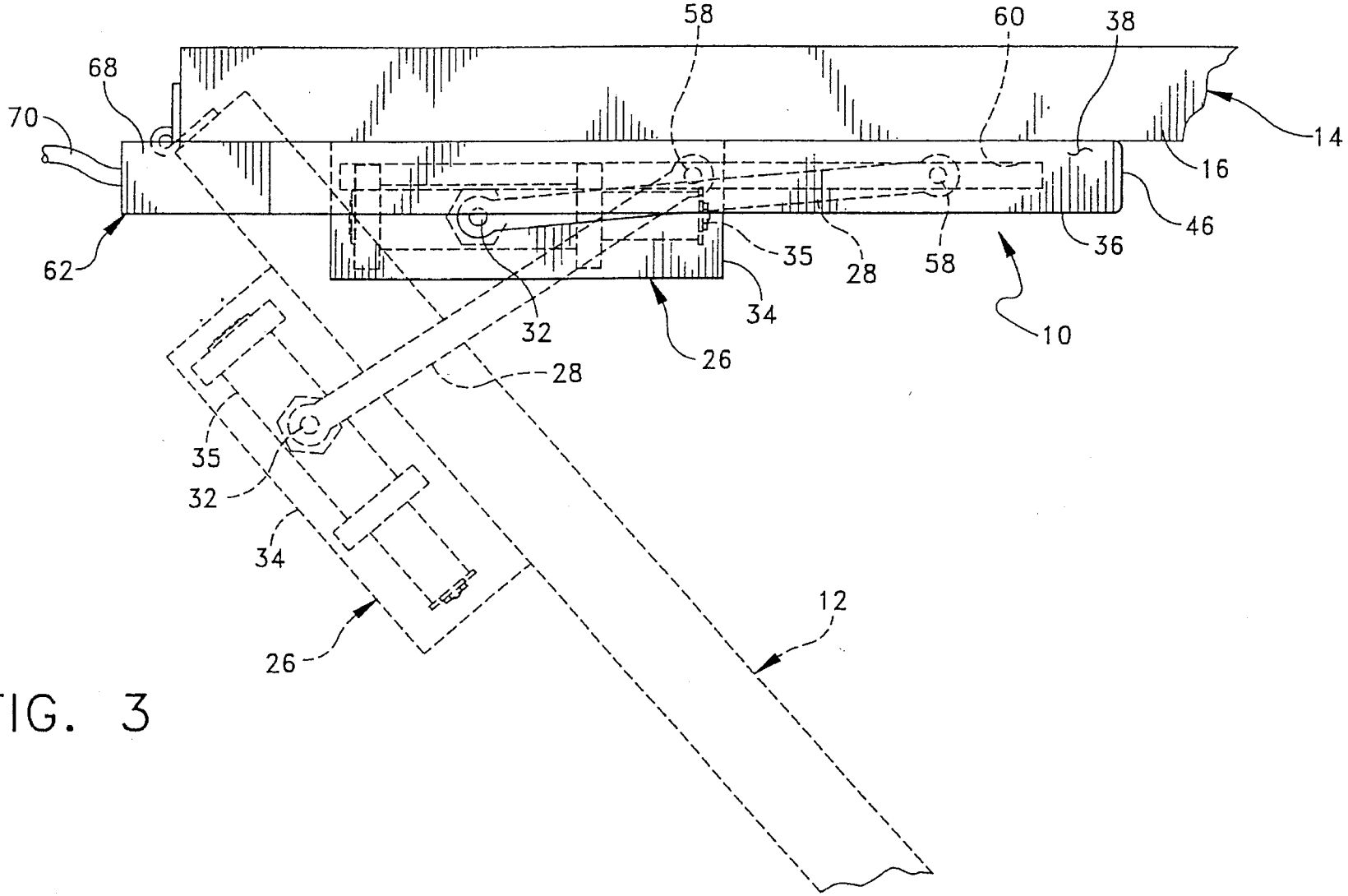
FIG. 3 is a top plan view with portions removed of the door operator illustrating the door in broken lines in an opened position.

As shown in FIG. 2, the door closer assembly 26 is mounted on the door 12 adjacent its upper edge. One end of the arm link 28 is pivotally attached to the shaft 32 of the door closer assembly 26 which is mounted on the door 12 by screw fasteners (not shown). The housing 34 includes a compression spring mechanism 35 (illustrated in broken lines in FIGS. 2–4) for providing a closing force on the shaft 32 of the door closer assembly 26 and the arm link 28 which is sufficient for closing the door 12 when it is in an open position. The compression spring mechanism 35 is interconnected between the door closer assembly 26 and the arm link 28 by the shaft of the door closer assembly and applies a moment force on the arm link 28 in the clockwise direction (as illustrated in FIG. 3) for closing the door 12. The arrangement can equally be designed for applying a force in a counterclockwise direction if desired. The housing 34, along with the other component parts of the door closer assembly 26, may be fabricated from rigid metal, such as steel. This construction of the door closer assembly 26 is well-known in the art of door closer assemblies and the arrangement in FIGS. 1–3 may embody other constructions and still fall within the scope of the present invention.

Turning now to FIGS. 2 and 3, the door operator 10 comprises an elongate track housing 36 mounted on the top door frame member 16 along a generally horizontal axis A. The track housing 36 is rectangular in construction and comprises a top wall 38, a bottom wall 40, a rear wall 42 which is placed adjacent the door frame member 16 when mounting the track housing thereto, a front wall 44 and a right-hand end wall 46. The track housing 36 may also be fabricated from steel along with the other components of the door operator 10. As shown, the door operator 10 includes a threaded power screw 48 mounted within the interior of the track housing 36 by a pair of bearings each indicated at 50. As illustrated in FIG. 2, the right-hand bearing 50 is positioned adjacent the end wall 46 of the track housing 36 and supports the right-hand end of the power screw 48. Similarly, the left-hand bearing 50 is positioned at the left-hand side of the track housing 36 and supports the left-hand end of the power screw 48. The bearings 50 enable the power screw 48 to rotate about the horizontal axis A when a rotational force is applied on the power screw 48. The bearings 50 supporting the power screw 48 are well-known and can be chosen from any number of commercial suppliers of bearings.

A slider block 52 having a threaded bore 54 is mounted on the power screw 48 in a position where the power screw 48 is threadably received in the threaded bore 54. The slider block 52 is sized for being received in the interior of the track housing 36 without interfering with the walls 38, 40, 42 and 44 thereof. The other end of the closer arm link 28 is pivotally connected to the slider block 52 by a pin 58 fixedly mounted on the slider block 52. The slider block 52 is capable of moving linearly back-and-forth within the interior of the track housing 36 as the power screw 48 rotates. The bottom wall 40 of the track housing 36 has an elongate slot 60 formed therein through which the pin 58 projects thereby enabling the slider block 52 to move linearly from side-to-side within the track housing 36 without the pin 58 interfering with the bottom wall 40. Alternatively, the bottom wall 40 can be eliminated from the track housing 36 altogether whereby the pin 58 can extend through the open bottom of the track housing 36.

A drive, generally indicated at 62, is mounted at one end of the track housing 36 by any suitable manner (e.g., as by welding or by bolt fasteners). The drive 62 has a shaft 64 suitably connected by a coupler 66 to the power screw 48 for powering the rotational movement of the power screw 48 about the horizontal axis A. The drive 62 includes a housing 68 attached to the track housing 36 and suitable means (not shown) for driving the rotational movement of its shaft 64 which provides a rotational force on the power screw 48. The drive 62 can be electrically, pneumatically, or hydraulically powered. The control device 18 is suitably connected to the drive by a wire 70 for providing the electrical communication between the two components and powering the operation of the drive 62. Another wire 72 is also provided for electrically connecting the switch plate 22 with the control device 18.

Figure 4:
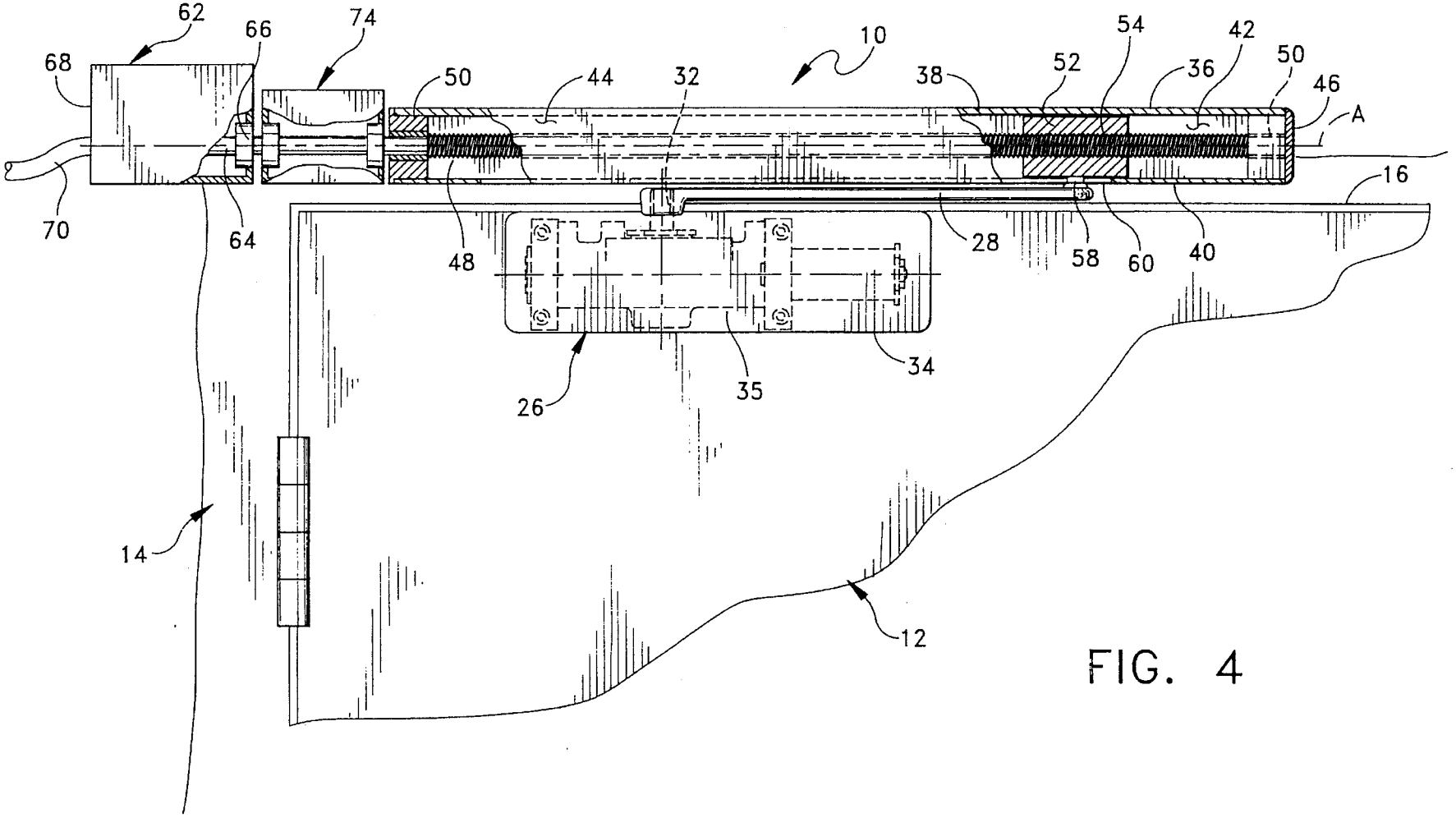
FIG. 4 is a view similar to FIG. 3 illustrating an alternative embodiment of the door operator.

FIG. 4 illustrates an alternative embodiment of the present invention having the same component parts illustrated in FIGS. 1–3 along with a clutch mechanism, generally designated 74, which couples the drive 62 and power screw 48. The clutch mechanism 74 enables the door 12 to be moved to its closed position in opposition to the rotational movement of the shaft 64 of the drive 62 and the power screw 48 without causing damage to the drive 62. This arrangement prevents damage to the drive 62 and door operator 10 when a person attempts to close the door 12 during the opening action of the door operator 10.

Preferably, the drive 62 is constructed and arranged such that the power screw 48 is capable of freely rotating when the drive 62 is inoperative. More specifically, the drive 62 is capable of rotating the power screw 48 when opening the door 12 and allows the power screw 48 to freely rotate axially when the door opener 10 is not in use. This enables the door closer assembly 26 to close the door 12 by moving the slider block 52 along the power screw 48, or a person to manually open the door 12 without the aid of the door operator 10.

During operation and use of the door operator 10, as a person approaches the pair of doors 12 illustrated in FIG. 1 in a closed position, the person may selectively press the switch plate 22 for opening at least one of the doors 12 automatically. Upon pressing the switch plate 22, the control device 18 powers the operation of the drive 62 for moving the door 12 between its closed position to its open position. More specifically, the drive 62 rotates the power screw 48 for moving the slider block 52 from a first position (i.e., the right-hand position as illustrated in FIG. 2) in which the door 12 is closed to a second position (i.e., left-hand position) in which the door 12 is fully opened. The control device 18 can be programmed for opening the door 12 at any desired angle of rotation instead of its fully opened position. The control device 18 can also be programmed to hold the door 12 open for a selected period of time for enabling the person to go through the opening without the door 12 impeding his or her access therethrough. After the selected period of time has elapsed, power to the drive 62 is cut-off and the door closer assembly 26 via arm link 28 provides a closing force on the slider block 52 for moving it to its first position for closing the door 12. Alternatively, in an instance where there is no door closer assembly 26 provided, the control device 18 can be programmed for rotating the power screw 48 in an opposite direction for moving the slider block 52 to its first position. Of course, in such an arrangement, the drive 62 is designed for rotating the power screw for opening and closing the door and not just opening it.

While this invention has been illustrated and described in accordance with a preferred embodiment, it is recognized that variations and changes may be made therein without departing from the invention as set forth in the following claims.

Having described the invention, what is claimed is:

1. A track driven power door operator for selectively and automatically opening a door swingably mounted on a door frame, said power door operator comprising:

an elongate track housing mounted on the door frame along a generally horizontal axis;

a power screw disposed within the track housing, said power screw extending along said horizontal axis;

a drive for powering the rotation of the power screw about said horizontal axis;

a slider block having a threaded bore threadably engaging said power screw, said slider block being moved linearly along said horizontal axis upon activation of the drive and the rotational movement of the power screw;

an arm link pivotally connected at one of its ends to the slider block and pivotally connected at its other end to the door; and a control for controlling the operation of the drive for moving the door between a closed position and an open position, said control activating said drive for moving the slider block from a first position in which the door is closed to a second position in which the door is fully open, and any position in between.

2. A power door operator as set forth in claim 1 further comprising a door closer assembly pivotally attached to the arm link for providing a closing force on the door, said door closer assembly having a housing mounted on said door, and means for providing a closing force on the arm link contained within said housing of the door closer assembly for closing the door when it is an open position.

3. A power door operator as set forth in claim 2, said drive rotating the power screw when opening the door and allowing the power screw to freely rotate axially when the door operator is not in use thereby enabling said door closer assembly to move the slider block to its first position.

4. A power door operator as set forth in claim 1, said drive being mounted at one end of the track housing.

5. A power door operator as set forth in claim 1, said power screw being supported by a pair of spaced-apart bearings which are mounted on the interior of the track housing.

6. A power door operator as set forth in claim 1, said control being in electrical communication with a switch accessible by a handicapped person for opening the door.

7. A power door operator as set forth in claim 1 further comprising a clutch mechanism which couples the power screw and the drive, said clutch mechanism enabling the door to be moved to its closed position in opposition to the rotational direction of the drive and the power screw without causing damage to the drive.

8. A power door operator as set forth in claim 1, wherein said control for controlling the operation of the drive is reversible for causing said door operator to function as a door closer.

* * * * *